US007620545B2

(12) United States Patent
Chiu et al.

(10) Patent No.: US 7,620,545 B2
(45) Date of Patent: Nov. 17, 2009

(54) SCALE FACTOR BASED BIT SHIFTING IN FINE GRANULARITY SCALABILITY AUDIO CODING

(75) Inventors: Te-Ming Chiu, Sinwu Township, Taoyuan County (TW); Fang-Chu Chen, Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 689 days.

(21) Appl. No.: 10/714,617

(22) Filed: Nov. 18, 2003

(65) Prior Publication Data

US 2005/0010395 A1 Jan. 13, 2005

(51) Int. Cl.
*G10L 19/02* (2006.01)
*G10L 19/00* (2006.01)
*G10L 11/00* (2006.01)

(52) U.S. Cl. ..... 704/229; 704/200; 704/201

(58) Field of Classification Search ..... 704/229, 704/200, 201
See application file for complete search history.

(56) References Cited

U.S. PATENT DOCUMENTS 4,149,263 A * 4/1979 Prioste ..... 377/69
4,727,506 A * 2/1988 Fling ..... 708/551
5,367,608 A * 11/1994 Veldhuis et al. ..... 704/229
5,758,315 A * 5/1998 Mori ..... 704/229
6,263,022 B1 * 7/2001 Chen et al. ..... 375/240.03
6,349,284 B1 * 2/2002 Park et al. ..... 704/500
6,456,963 B1 * 9/2002 Araki ..... 704/200.1
6,529,604 B1 * 3/2003 Park et al. ..... 381/22
6,542,863 B1 * 4/2003 Surucu ..... 704/200.1
6,639,943 B1 * 10/2003 Radha et al. ..... 375/240.11
6,678,647 B1 * 1/2004 Edler et al. ..... 704/200.1
6,678,653 B1 * 1/2004 Tsushima et al. ..... 704/220
6,728,739 B1 * 4/2004 Kobayashi et al. ..... 708/208
6,792,044 B2 * 9/2004 Peng et al. ..... 375/240.03
6,931,060 B1 * 8/2005 Jiang et al. ..... 375/240.03
6,931,370 B1 * 8/2005 McDowell ..... 704/200.1
7,103,316 B1 * 9/2006 Hall ..... 455/63.1

(Continued)

OTHER PUBLICATIONS

Li, "Overview of Fine Granularity Scalability in MPEG-4 Video Standard", IEEE Transactions on Circuits and Systems for Video Technology, vol. 11, No. 3, Mar. 2001.*

(Continued)

*Primary Examiner*—Richemond Dorvil
*Assistant Examiner*—Eric Yen
(74) *Attorney, Agent, or Firm*—Finnegan, Henderson, Farabow, Garrett & Dunner LLP

(57) ABSTRACT

One embodiment of the present invention provides a method coding audio signals in a base layer and an enhancement layer comprising the steps of quantizing the audio signals in spectral lines into quantized data in a plurality of sub-bands in an order of most significant bits (MSBs) to least significant bits (LSBs), determining a plurality of scale factors corresponding to each of the sub-bands according to respective noise tolerance of each of the sub-bands, bit shifting the quantized data in the sub-bands by the respective scale factor if they exceed a threshold value, coding the quantized data in the base layer, coding the quantized data in the enhancement layer, truncating the quantized data in the enhancement layer up to respective layer size limits, de-shifting the coded data wit the respective scale factors, de-quantizing the coded data, and decoding the coded data.

38 Claims, 8 Drawing Sheets

| band | scalefactor | band | scalefactor |
|---|---|---|---|
| 1 | 0 | 25 | 0 |
| 2 | 0 | 26 | 0 |
| 3 | 0 | 27 | 1 |
| 4 | 0 | 28 | 1 |
| 5 | 0 | 29 | 0 |
| 6 | 1 | 30 | 0 |
| 7 | 2 | 31 | 0 |
| 8 | 0 | 32 | 1 |
| 9 | 0 | 33 | 0 |
| 10 | 0 | 34 | 0 |
| 11 | 1 | 35 | 0 |
| 12 | 0 | 36 | 0 |
| 13 | 0 | 37 | 0 |
| 14 | 3 | 38 | 0 |
| 15 | 1 | 39 | 0 |
| 16 | 3 | 40 | X |
| 17 | 4 | 41 | X |
| 18 | 3 | 42 | 1 |
| 19 | 2 | 43 | X |
| 20 | 3 | 44 | X |
| 21 | 1 | 45 | X |
| 22 | 3 | 46 | 0 |
| 23 | 0 | 47 | 0 |
| 24 | 1 | 48 | X |
| | | 49 | X |

U.S. PATENT DOCUMENTS

| | | | | |
|---|---|---|---|---|
| 7,181,079 | B2 * | 2/2007 | Herre et al. | 382/251 |
| 7,190,832 | B2 * | 3/2007 | Frost et al. | 382/173 |
| 7,260,226 | B1 * | 8/2007 | Miura et al. | 381/56 |
| 7,318,027 | B2 * | 1/2008 | Lennon et al. | 704/229 |
| 7,373,293 | B2 * | 5/2008 | Chang et al. | 704/200.1 |
| 7,391,813 | B2 * | 6/2008 | Shinsho | 375/242 |
| 7,454,327 | B1 * | 11/2008 | Neubauer et al. | 704/200.1 |
| 2002/0076049 | A1 * | 6/2002 | Boykin et al. | 380/211 |
| 2003/0079222 | A1 * | 4/2003 | Boykin et al. | 725/31 |
| 2003/0091194 | A1 * | 5/2003 | Teichmann et al. | 381/2 |

OTHER PUBLICATIONS

Jayant et al., "Signal Compression Based on Models of Human Perception", Proceedings of the IEEE, vol. 81, No. 10, Oct. 1993.*

Audio Subgroup, International Organization for Standardization Organization International Normalisation ISO/IEC JTC 1/SC 29/WG 11 Coding of Moving Pictures and Audio, SFBBS on BSAC System, N10084, Oct. 2003.

* cited by examiner

| band | scalefactor | band | scalefactor |
|---|---|---|---|
| 1 | 0 | 25 | 0 |
| 2 | 0 | 26 | 0 |
| 3 | 0 | 27 | 1 |
| 4 | 0 | 28 | 1 |
| 5 | 0 | 29 | 0 |
| 6 | 1 | 30 | 0 |
| 7 | 2 | 31 | 0 |
| 8 | 0 | 32 | 1 |
| 9 | 0 | 33 | 0 |
| 10 | 0 | 34 | 0 |
| 11 | 1 | 35 | 0 |
| 12 | 0 | 36 | 0 |
| 13 | 0 | 37 | 0 |
| 14 | 3 | 38 | 0 |
| 15 | 1 | 39 | 0 |
| 16 | 3 | 40 | X |
| 17 | 4 | 41 | X |
| 18 | 3 | 42 | 1 |
| 19 | 2 | 43 | X |
| 20 | 3 | 44 | X |
| 21 | 1 | 45 | X |
| 22 | 3 | 46 | 0 |
| 23 | 0 | 47 | 0 |
| 24 | 1 | 48 | X |
| | | 49 | X |

FIG. 2b

SCALE FACTOR BASED BIT SHIFTING IN FINE GRANULARITY SCALABILITY AUDIO CODING

FIELD OF THE INVENTION

The present invention generally relates to audio coding and, more particularly, to scale factor based bit shifting (SFBBS) in fine granularity scalability (FGS) audio coding.

BACKGROUND OF THE INVENTION

Fine granularity scalability (FGS) includes a multitude of audio coding applications such as real-time multimedia streaming and dynamic multimedia storage. In particular, FGS has been adopted by the Motion Picture Experts Group (MPEG) and incorporated into the MPEG 4 international standard, including AAC.

In conventional coding such as AAC in MPEG-4, first codes of the information are used in left and right channels at a place of the header in processing audio signals. The left-channel data are coded and the right-channel data are then coded. That is, coding is processed in the order of the header, left and right channels. When information for the left and right channels are arranged and transmitted irrespective of significance after the header is processed in such a manner, signals for the right channel positioned backwards will disappear first if the bit rate is lowered. The transmission performance will seriously degrade as a result.

In FGS audio coding, a base layer and an enhancement layer are transmitted. The single enhancement layer, after quantization of the data therein, is transmitted with varied bit rates. Truncation of the quantized data also takes place as layer size limits are applied in the enhancement layer. Noise shaping is implemented to minimize quantization noise, under a masking level so it will be imperceptible to the human ear. For noise shaping, psychoacoustics are applied to control errors in the quantization process with scale factors being associated with a plurality of sub-bands. The most important characteristics of human acoustics in coding a digital audio signal include a masking effect (as an audio signal is inaudible due to another signal) and a critical band feature (as noises having the same amplitude are differently perceived when the noise signal is within or without a critical band). These characteristics are utilized so the range of noise allocated within a critical band is calculated in generating quantization noise corresponding to the calculated range to minimize data loss due to the coding. However, errors introduced by the disposal of the truncated data are not governed by the psychoacoustic model.

There is thus a general need in the art for a method and system of audio coding to overcome at least the aforementioned shortcomings in the art. A particular need exists in the art for an optimal method and system in audio coding overcoming performance degradation issues when information in channels are arranged and transmitted irrespective of significance as the bit rate is lowered. A further need exists in the art for an optimal FGS method and system in audio coding overcoming the limitations of the psychoacoustic model in controlling errors in truncation of quantized data.

SUMMARY OF THE INVENTION

Accordingly, one embodiment of the present invention is directed to a scale factor based bit shifting (SFBBS) method and system in FGS audio coding that obviate one or more of the problems due to limitations and disadvantages of the related art.

To achieve these and other advantages, as the audio signals are quantized in an order of most significant bits (MSBs) to least significant bits (LSBs), the significance of the MSBs is increased with respect to the LSBs. In the plurality of sub-bands in which the audio signals are quantized, the MSBs are shifted upwards in terms of significance by the respective scale factors assigned thereto by the psychoacoustic model. Scale factors correspond to the noise tolerance in each of the sub-bands. The sub-bands with less error tolerance are generally associated with larger scale factors. Small error tolerance means that the human ear will be more sensitive to the frequency range defined by the sub-band corresponding to that small error tolerance. That is, if the error tolerance is small in a sub-band, the quantized data in that sub-band are more significant as they must be more sensitive to the human ear. If the scale factor in a particular sub-band exceeds a threshold value, the quantized data in that sub-band are shifted by the respective scale factor, i.e., the bits in that sub-band are shifted upwards by the same number of significance levels as the value of the sub-band's scale factor.

In accordance with the purpose of the invention as generally embodied and broadly described, there is provided a scale factor based bit shifting (SFBBS) processor processing audio signals in an order of most significant bits to least significant bits that includes a psychoacoustic model determining a plurality of scale factors corresponding to a plurality of spectral sub-bands according to respective noise tolerance of each of the sub-bands, a bit shifter shifting the processed audio signals in the spectral sub-bands by the respective scale factors if they exceed a threshold value, and a bit slicer coding and truncating the processed audio signals.

In another aspect, the SFBBS processor according to the invention further comprises a quantizer quantizing the processed audio signals. Such SFBBS processor can be implemented in MPEG AAC.

In yet another aspect, the SFBBS processor according to the invention further comprises a quantizer and de-quantizer respectively quantizing and de-quantizing the processed audio signals, and a subtractor taking a difference between the and the de-quantized audio signals. Such SFBBS processor can be implemented in MPEG-4 bit slice arithmetic coding (BSAC).

There is also provided a method for processing audio signals comprising the steps of quantizing the audio signals in spectral lines into quantized data in a plurality of sub-bands in an order of most significant bits to least significant bits, determining a plurality of scale factors corresponding to each of the sub-bands according to respective noise tolerance of each of the sub-bands, bit shifting the quantized data by the respective scale factors if they exceed a threshold value, coding the quantized data, truncating the quantized data, de-shifting the coded data with the respective scale factors, de-quantizing the coded data, and decoding the coded data.

According to a further embodiment according to the present invention, there is provided a method for coding audio signals in a base layer and an enhancement layer comprising the steps of quantizing the audio signals in spectral lines into quantized data in a plurality of sub-bands in an order of most significant bits to least significant bits, determining a plurality of scale factors corresponding to each of the sub-bands according to respective noise tolerance of each of the sub-bands, bit shifting the quantized data by the respective scale factors if they exceed a threshold value, coding the quantized data in the base layer, coding the quantized data in the enhancement layer, truncating the quantized data in the enhancement layer up to respective layer size limits, de-shifting the coded data with the respective scale factors, de-quantizing the coded data, and decoding the coded data.

In one aspect, the method according to the invention is implemented in MPEG additive arithmetic coding (AAC) or MPEG-4 bit slice arithmetic coding (BSAC).

In another aspect, the method according to the invention utilizes Huffman coding, run length (RL) coding or arithmetic coding (AC), e.g., in an MPEG 4 AAC system having an AAC encoder and AAC decoder.

In an additional aspect, the method according to the invention further comprises the steps of amplifying the coded data with the respective scale factors, and de-amplifying the decoded data with the respective scale factors.

Further in accordance with another embodiment, there is provided an SFBBS structure having an encoder and decoder for coding and transmitting a base layer and an enhancement layer according to the present invention. Since most of the errors are generated during quantization, a de-quantizer is advantageously provided in the encoder and the difference of the data being coded is taken before and after quantization. As the SFBBS are performed, the single enhancement layer is accordingly constructed.

An exemplary encoder in an SFBBS structure according to one embodiment of the present invention primarily comprises a psychoacoustic model, filter, quantizer, noiseless coder, subtractor, de-quantizer, shifter and bit slicer. A decoder of an additive SFBBS structure according to the present invention primarily comprises a scale factor decoder, spectrum decoder, de-quantizer, adder, filter, de-shifter and bitmap decoder.

In one aspect, the SFBBS structure according to the invention is implemented in MPEG AAC or MPEG-4 BSAC.

A scale factor based bit shifting (SFBBS) system in an additive fine granularity scalability (FGS) structure according to the present invention comprises an encoder including a quantizer quantizing the audio signals in spectral lines into quantized data and errors in a plurality of sub-bands in an order of most significant bits to least significant bits, a psychoacoustic model determining a plurality of scale factors corresponding to each of the sub-bands according to respective noise tolerance of each of the sub-bands, a coder coding the quantized data in the base layer, a de-quantizer de-quantizing the quantized data, a subtractor taking a difference of the quantized data and the de-quantized data, a bit shifter shifting the difference between the quantized and de-quantized data in the sub-bands by the respective scale factors if they exceed a threshold value, and a bit slicer coding the and truncating the difference between the quantized and de-quantized data. The system according to this particular embodiment of the present invention further comprises a decoder having a scale factor decoder decoding the scale factors, a spectrum decoder decoding the quantized data, a de-quantizer de-quantizing the quantized data, a de-shifter de-shifting the coded data, and a decoder decoding the coded data.

In a further aspect, an SFBBS system is further provided for implementation with bit slice arithmetic coding (BSAC) in MPEG4.

A particular advantage of the present invention is that no further information will need to be sent in the enhancement layer, advantageously avoiding bandwidth issues and additional overhead as the audio signal quality is optimized by as much as 3 decibels. As the scale factors are utilized in SFBBS, the present invention is wholly scalable and compatible with FGS audio systems.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

It is to be understood that both the foregoing general description and the following detailed description are exemplary and explanatory only and are not restrictive of the invention as claimed.

The accompanying drawings, which are incorporated in and constitute a part of this specification, illustrate several embodiments of the invention and together with the description, serve to explain the principles of the invention.

BRIEF DESCRIPTION OF THE DRAWINGS

FIGS. 2*b* and 2*c* are respectively a table and a graph illustrating the relationship between a plurality of scale factors and a masking curve of a single MPEG-4 AAC coded frame.

DESCRIPTION OF THE EMBODIMENTS

Reference will now be made in detail to the present embodiment of the invention, an example of which is illustrated in the accompanying drawings. Wherever possible, the same reference numbers will be used throughout the drawings to refer to the same or like parts.

Figure 1:
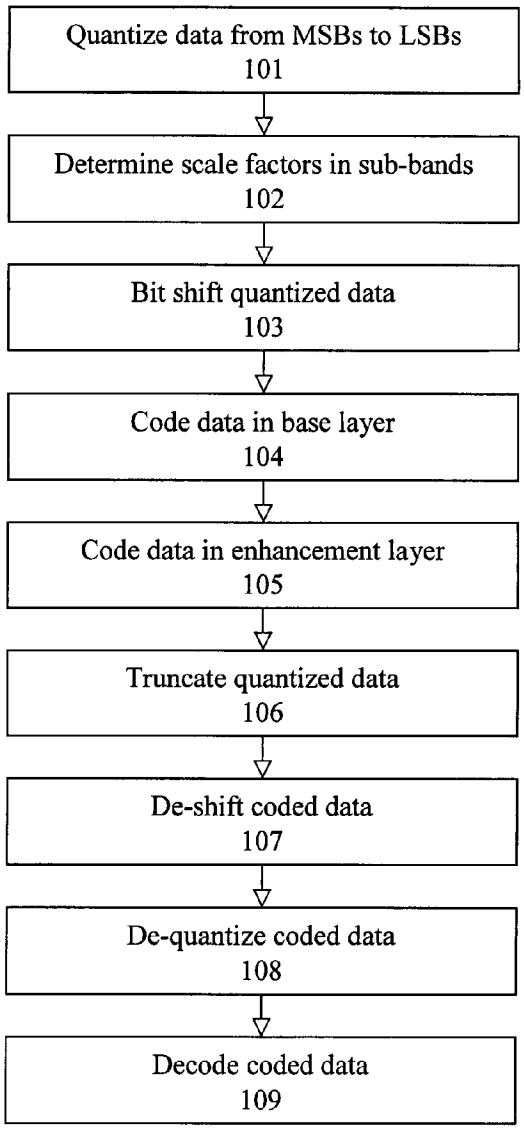
FIG. 1 is a flow diagram exemplarily illustrating a communications method according to an embodiment of the present invention.

FIG. 1 is a flow diagram of a communications method according to one embodiment of the present invention. Referring to FIG. 1, there is provided a method for coding audio signals in a base layer and an enhancement layer comprising the steps of quantizing the audio signals in spectral lines into quantized data in a plurality of sub-bands in an order of most significant bits to least significant bits (step 101), determining a plurality of scale factors corresponding to each of the sub-bands according to respective noise tolerance of each of the sub-bands (step 102), bit shifting the quantized data by the respective scale factors if they exceed a threshold value (step 103), coding the quantized data in the base layer (step 104) and the enhancement layer (step 105), truncating the quantized data in the enhancement layer up to respective layer size limits (step 106), de-shifting the coded data with the respective scale factors (step 107), de-quantizing the coded data (step 108), and decoding the coded data (step 109). In one aspect, the method according to this particular embodiment is advantageously implemented in MPEG-4 BSAC.

In another aspect, the method according to the present invention utilizes Huffman coding, run length (RL) coding or arithmetic coding (AC).

In yet another aspect, the method according to the present invention further comprises the steps of converting the audio signals from a time domain to a frequency domain, e.g., through modified discrete cosine transform (MDCT), and converting the decoded data from the frequency domain to the time domain by IMDCT.

In an additional aspect, the method according to the invention further comprises the steps of amplifying the coded data with the respective scale factors, and de-amplifying the decoded data with the respective scale factors.

As the audio signals are quantized in an order of most significant bits (MSBs) to least significant bits (LSBs), a particular advantage of the present invention is that the significance of the MSBs is increased with respect to the LSBs. In the plurality of sub-bands in which the audio signals are quantized, the MSBs are shifted upwards in terms of significance by the respective scale factors assigned thereto by the psychoacoustic model.

The method according to a further embodiment of the invention advantageously comprises quantizing the audio signals in spectral lines into quantized data in a plurality of sub-bands in an order of most significant bits to least significant bits, determining a plurality of scale factors corresponding to each of the sub-bands according to respective noise tolerance of each of the sub-bands, de-quantizing the quantized data, bit shifting the difference between the quantized and de-quantized data in the sub-bands by the respective scale factors if they exceed a threshold value, coding and truncating the quantized difference. In one aspect, the method according to this particular embodiment is implemented in MPEG AAC.

Figure 2A:
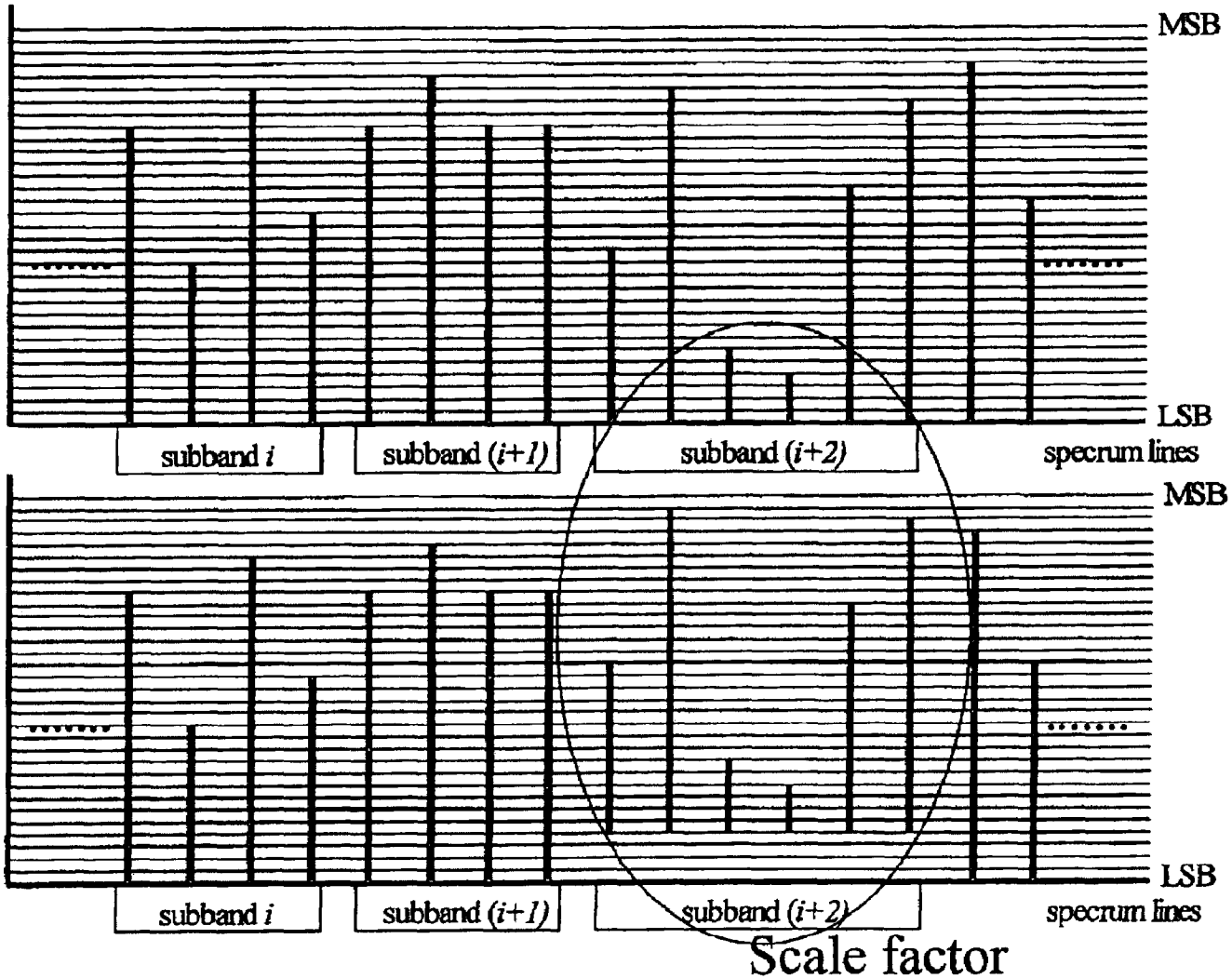
FIG. 2*a* is a spectral diagram exemplarily illustrating the scale factor based bit shifting (SFBBS) according to the present invention.

FIG. 2*a* is a spectral diagram exemplarily illustrating the scale factor based bit shifting (SFBBS) according to the present invention. Scale factors correspond to the noise tolerance in each of the sub-bands i, i+1, i+2 . . . in their respective spectral energy. The sub-bands with less error tolerance are generally associated with larger scale factors. Small error tolerance means that the human ear will be more sensitive to the frequency range defined by the sub-band corresponding to that small error tolerance. That is, if the error tolerance is small in a sub-band, the quantized data in that sub-band are more significant as they must be more sensitive to the human ear. If the scale factor in a particular sub-band exceeds a threshold value, the quantized data in that sub-band are shifted by the respective scale factor, i.e., the bits in that sub-band are shifted upwards by the same number of significance levels as the value of the sub-band's scale factor.

Figure 2C:
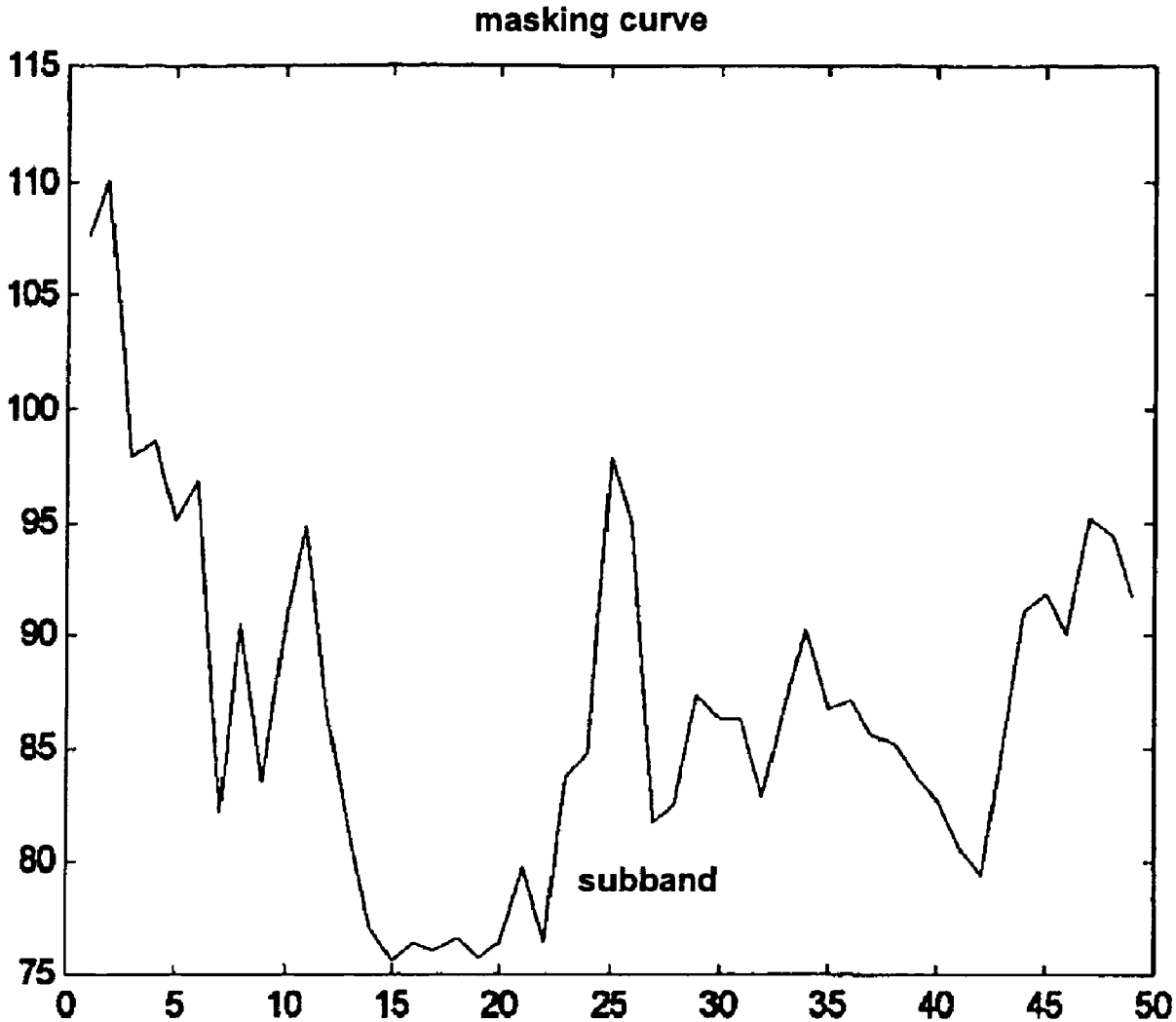

FIG. 2*b* and FIG. 2*c* exemplarily illustrate the relationship between a plurality of scale factors and the masking curve of a single MPEG-4 AAC coded frame in tabular and graphical forms, respectively. At the sub-bands where the masking level is smaller, the values of their respective scale factors are higher. The present invention advantageously exploits this relationship in scale factor-based bit shifting (SFBBS) in optimizing the decoded audio signal quality at low bit rates.

Accordingly, the invention generally provides a scale factor based bit shifting (SFBBS) processor processing audio signals in an order of most significant bits to least significant bits that includes a psychoacoustic model determining a plurality of scale factors corresponding to a plurality of spectral sub-bands according to respective noise tolerance of each of the sub-bands, a bit shifter shifting the processed audio signals in the spectral sub-bands by the respective scale factors if they exceed a threshold value, and a bit slicer coding and truncating the processed audio signals.

In another aspect, the SFBBS processor according to the invention further comprises a quantizer quantizing the processed audio signals. Such SFBBS processor can be implemented in MPEG AAC.

In yet another aspect, the SFBBS processor according to the invention further comprises a quantizer and de-quantizer respectively quantizing and de-quantizing the processed audio signals, and a subtractor taking a difference between the and the de-quantized audio signals. Such SFBBS processor can be implemented in MPEG-4 bit slice arithmetic coding (BSAC).

Referring again to FIG. 2, for example, sub-band (i+2) is a sub-band with low noise tolerance with a corresponding high scale factor. If the scale factor of the sub-band is 4, all bit values in the spectral lines in the sub-band are shifted upwards by 4 energy levels (as exemplarily shown in FIG. 2). Once these more significant bits are shifted, they are accordingly placed in the more important sub-bands (i.e., those with less error tolerance) closer to the beginning of the enhancement layer. After the bit shifting, some or all of the least significant bit values in the spectral lines are not coded or discarded, advantageously saving valuable bandwidth.

For high bit rate audio coding, the coding errors are kept under a masking level so they are imperceptible to the human ear. However, for low bit rate coding, the errors are still perceptible. Psychoacoustics are used in the encoder to minimize the perceptible errors. For a given bit rate, a psychoacoustic model is used in the encoder to best shape the noise level. The same noise shaping issue is encountered when an enhancement layer or parts thereof are added or improved, which is akin to changing the bit rate in the bit stream. It will be impractical if the bit rate allocation algorithm is recursively applied, since the actual bit rate for the received data in an enhancement layer cannot be foreseen by the encoder. The present invention advantageously utilizes psychoacoustics in noise shaping the coded data while optimizing the performance of the FGS enhancement layer. Even though the actual bit rate as seen by the decoder is not known to the encoder, the encoder can still perform noise shaping psychoacoustically, using scale factor-based bit shifting or SFBBS.

The methodology according to the invention can be described and iteratively expressed in an inner loop and an outer loop. An exemplary pseudo code expression for the inner loop is shown below:

```
if (counted_bits > available_bits) then
        common_scalefac = common_scalefac + quantizer_change
else
        common_scalefac = common_scalefac − quantizer_change
end if
```

According to expression (1), a common scale factor is determined by comparing the number of counted bits and available bits. If the number of counted bits is greater than the available bits, the common scale factor is increased by a positive quantization change. Conversely, if the number of counted bits is not greater than the available bits, the common scale factor is decreased by the quantization change.

An outer loop is used to determine the respective scale factor for each of the sub-bands. An exemplary pseudo code expression (2) for the outer loop is shown below:

```
do for each scalefactor band sb:
    error_energy(sb)=0
    do from lower index to upper index i of scalefactor band
        error_energy(sb) = error_energy(sb) + (abs( mdct_line(i)) −
                    (x_quant(i) ^(4/3) * 2^( −¼ *
                    (scalefactor(sb) −common_scalefac )))^2
    end do
end do
do for each scale factor band sb
        if ( error_energy(sb) > xmin(sb) ) then
                    scalefactor(sb) = scalefactor(sb) + 1
        end if
end do
```

According to expression (2), the error energy for each of the sub-bands is determined by taking the value of the original spectral energy level, e.g., through modified discrete cosine transform or MDCT, and adjusting it with de-quantization of the difference of the common scale factor and band scale factor values. Adjustment is made to the respective scale factor (i.e., incrementally by one) for each of the sub-bands if the error energy for the sub-band is greater than a threshold value.

Figure 3:
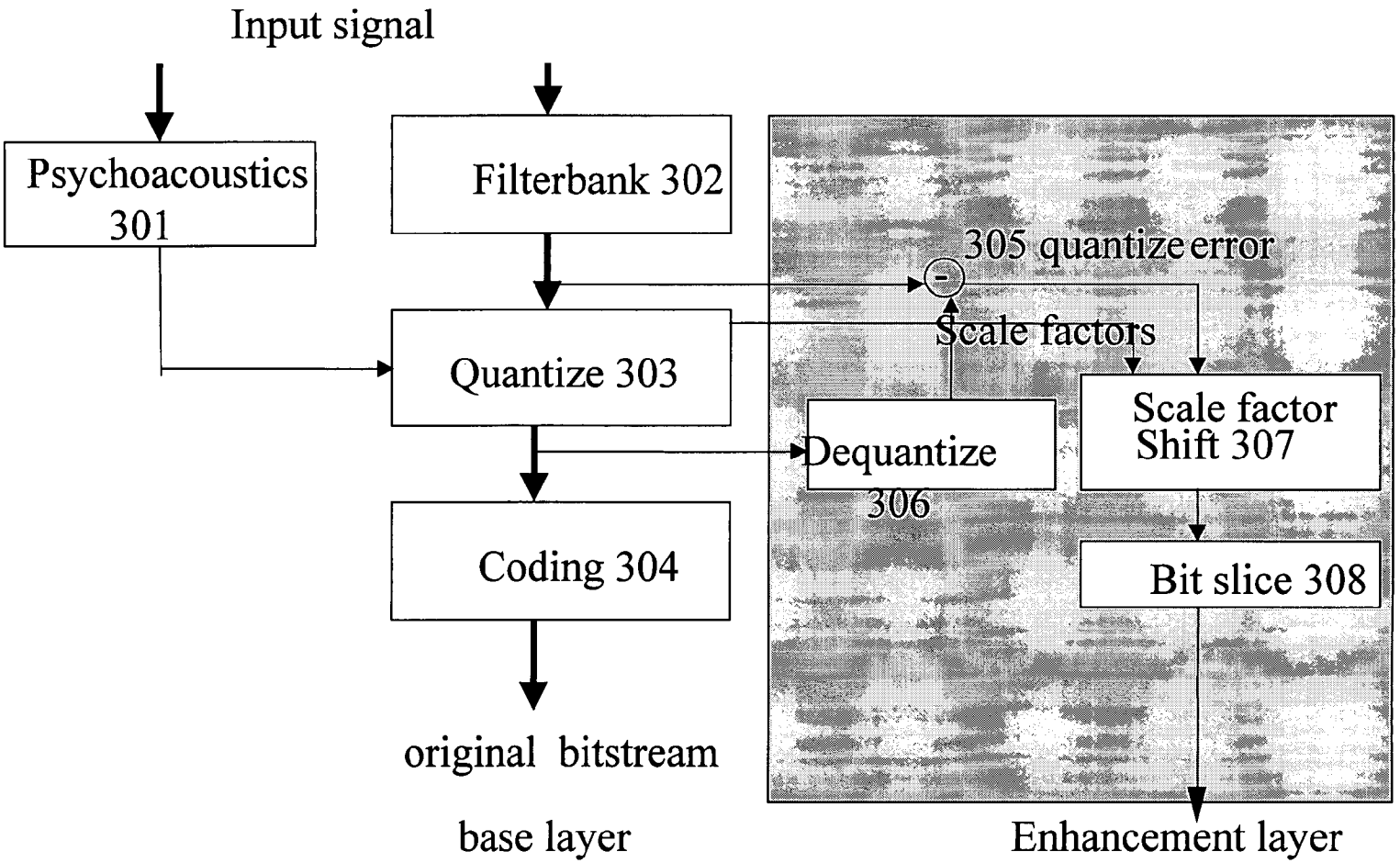
FIGS. 3 and 4 are diagrams illustrating an encoder and decoder of an additive SFBBS structure in accordance with the present invention.
Figure 4:
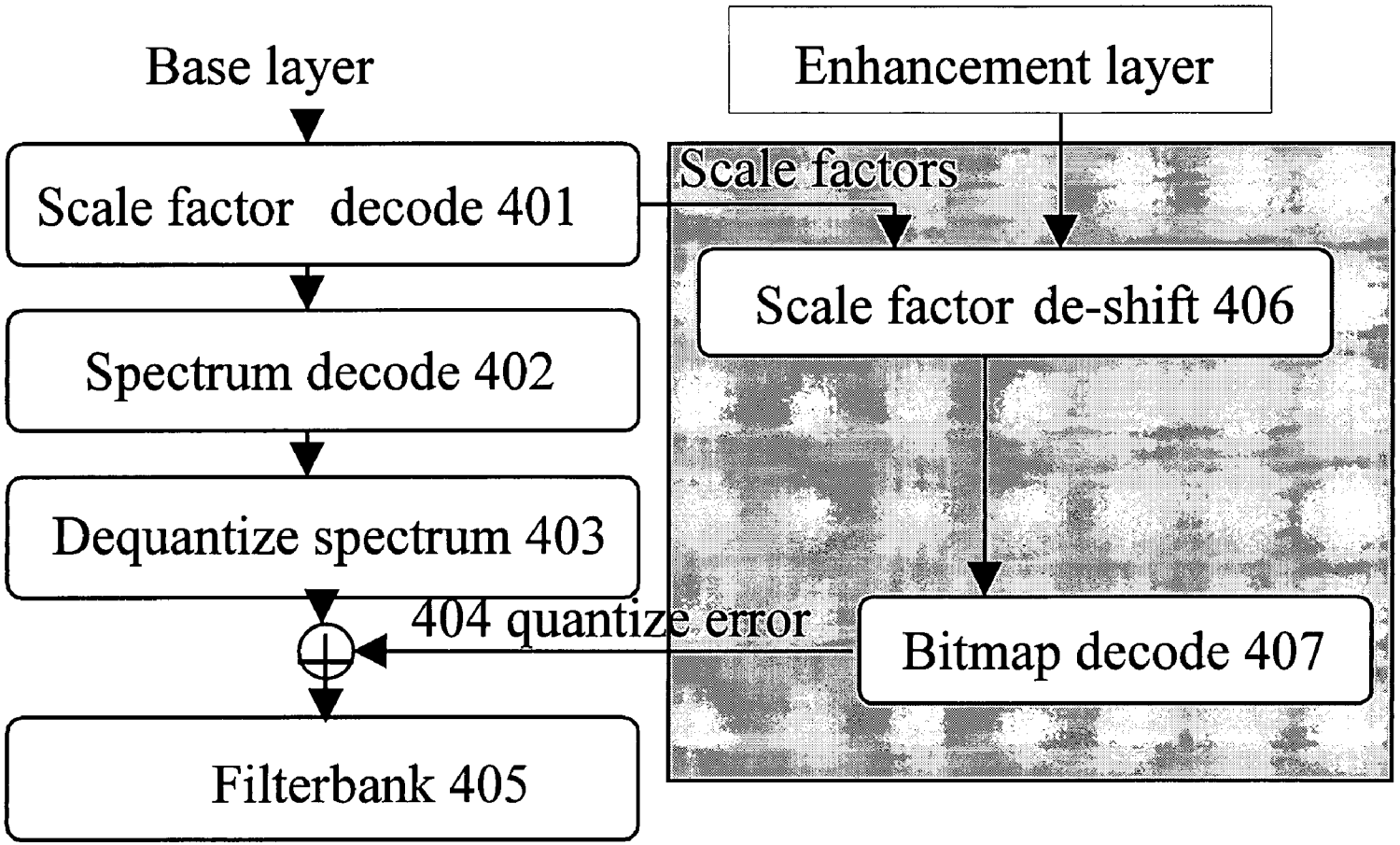

FIGS. 3 and 4 are diagrams illustrating an encoder and decoder of an additive SFBBS structure in accordance with the present invention. Since most of the errors are generated during quantization, a de-quantizer is advantageously provided in the encoder and the difference of the data being coded is taken before and after quantization. As the SFBBS and bit slice are performed, the single enhancement layer is accordingly constructed. In one aspect, this additive SFBBS structure is advantageously implemented in MPEG AAC.

For an additive fine granularity scalability (FGS) coding structure, there is provided a method according comprising the steps of quantizing the audio signals in spectral lines into quantized data and errors in a plurality of sub-bands in an order of most significant bits to least significant bits, determining a plurality of scale factors corresponding to each of the sub-bands according to respective noise tolerance of each of the sub-bands, bit shifting the quantized errors by the respective scale factors if they exceed a threshold value, coding the quantized data in the base layer, coding the quantized data in the enhancement layer, truncating the quantized data in the enhancement layer up to respective layer size limits, de-shifting the coded data with the respective scale factors, de-quantizing the coded data, and decoding the coded data.

Referring to FIG. 3, an encoder of an additive SFBBS structure for coding and transmitting a base layer and an enhancement layer according to the present invention comprises a psychoacoustic model 301, filter 302, quantizer 303, noiseless coder 304, subtractor 305, de-quantizer 306, shifter 307 and bit slicer 308. The original audio signals are input into the encoder at psychoacoustic model 301 and filter 302. Filter 302 converts the input audio signals from the time domain to signals in the frequency domain for further processing. Psychoacoustic model 301 couples the frequency-domain signals converted by filter 302 by signals of sub-bands corresponding to scale factors. A masking threshold at each sub-band is calculated using a masking phenomenon generated by interaction with the respective signals. Quantizer 303 quantizes the frequency-domain signals with respect to their spectral energy and their respective noise tolerance in a plurality of sub-bands. De-quantizer 306 is provided in the encoder and the difference of the data being coded is taken at subtractor 305 before and after quantization at quantizer 303. At the shifter 307, the quantized errors for the plurality of sub-bands are bit shifted by the respective scale factors if they exceed a threshold value. After bit slicing at the slicer 308, the single enhancement layer is coded and accordingly constructed. For bit slicing, instead of vertically sending the bits in the order of each word, the bits are horizontally sent in the order of each bit slice according to its significance in the respective bit array. After coding the enhancement layer, the bits with greater significance will be placed closer to the beginning of the enhancement layer. After noiseless coding in the coder 304, the base layer is coded and accordingly constructed.

A particular advantage is when only a part of the enhancement layer is received, the decoder of an additive SFBBS structure according to the present invention still will have the general shape of the entire spectrum, even though some of the details may have been lost. Advantageously according to the present invention, it will not matter at which point the enhancement layer is truncated, the received data will be decodable as long as they are received generally without error. The longer the enhancement layer is received at the decoder, the more detail can be decoded by the decoder, which in turn leads to superior audio signal quality.

After the quantization error is received, bit slicing is performed in bit slicer 308, after at least some of the bits have been shifted at shifter 307. The significance of bits that are originally less significant is increased as their respective position is moved toward the beginning of the enhancement layer and have them sent earlier. For shifting for the best performance, scale factors are utilized as the noise level is accordingly reshaped for each extra bit received from the enhancement layer. As the scale factors are received in the decoder, there is advantageously no need to send any extra information in the enhancement layer.

Referring to FIG. 4, a decoder of an additive SFBBS structure according to the present invention comprises a scale factor decoder 401, spectrum decoder 402, de-quantizer 403, adder 404, filter 405, de-shifter 406 and bitmap decoder 407. At the decoder 401, the coded data in the base layer and the corresponding scale factors are decoded. The coded data and their respective spectral lines are decoded at the spectrum decoder 402 and their respective spectral energy de-quantized at the de-quantizer 403. The coded data in the enhancement layer are de-shifted by the respective scale factors in the sub-bands at de-shifter 406. After decoding at bitmap decoder 407, the decoded data are forwarded to adder 404 to accordingly construct the audio signals. The decoded audio signals are then converted from the frequency domain to the time domain at filter 405.

Figure 5:
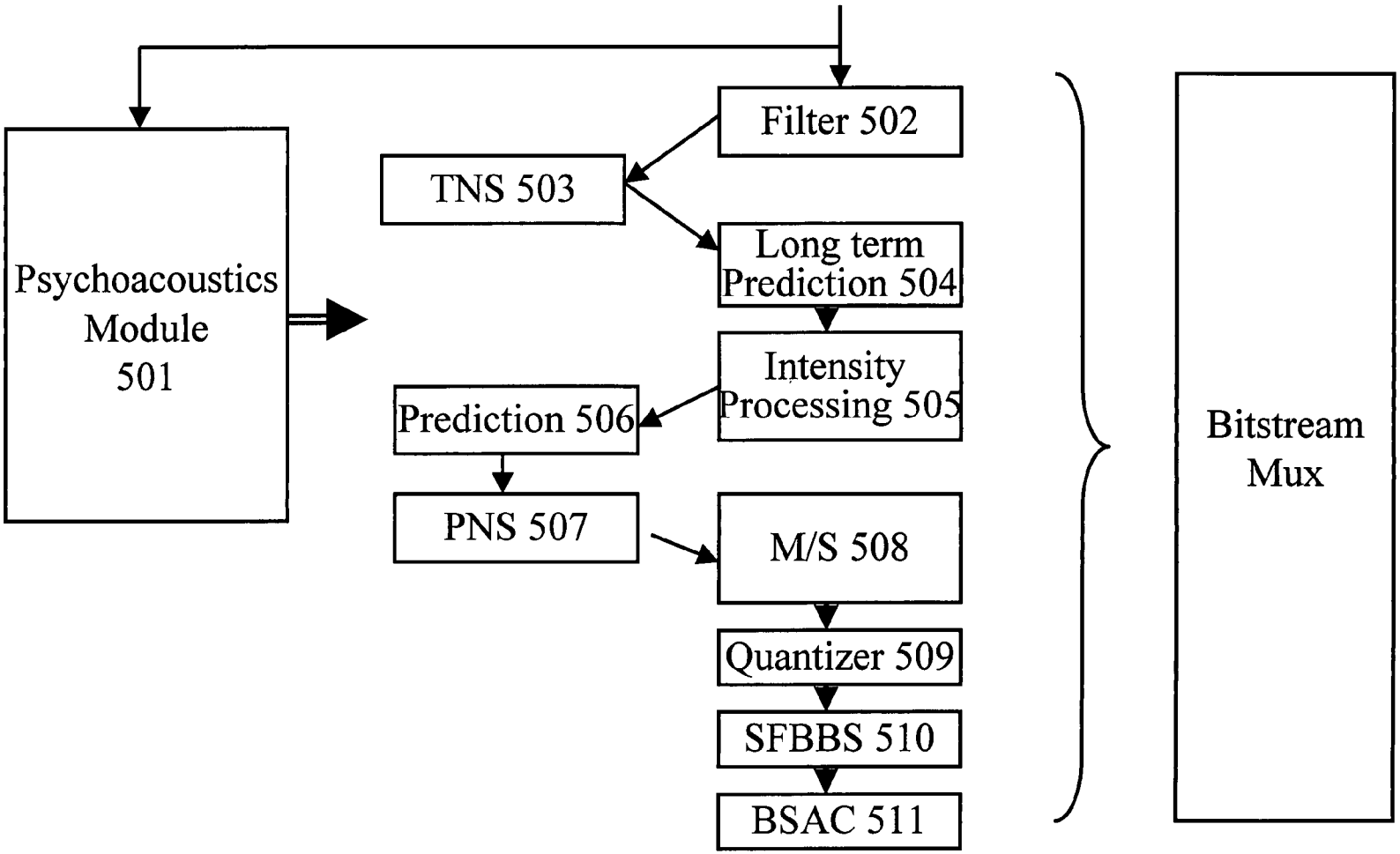
FIGS. 5 and 6 are block diagrams respectively illustrating an exemplary BSAC encoder and decoder with scale factor based bit shifting (SFBBS) according to yet another embodiment of the present invention.
Figure 6:
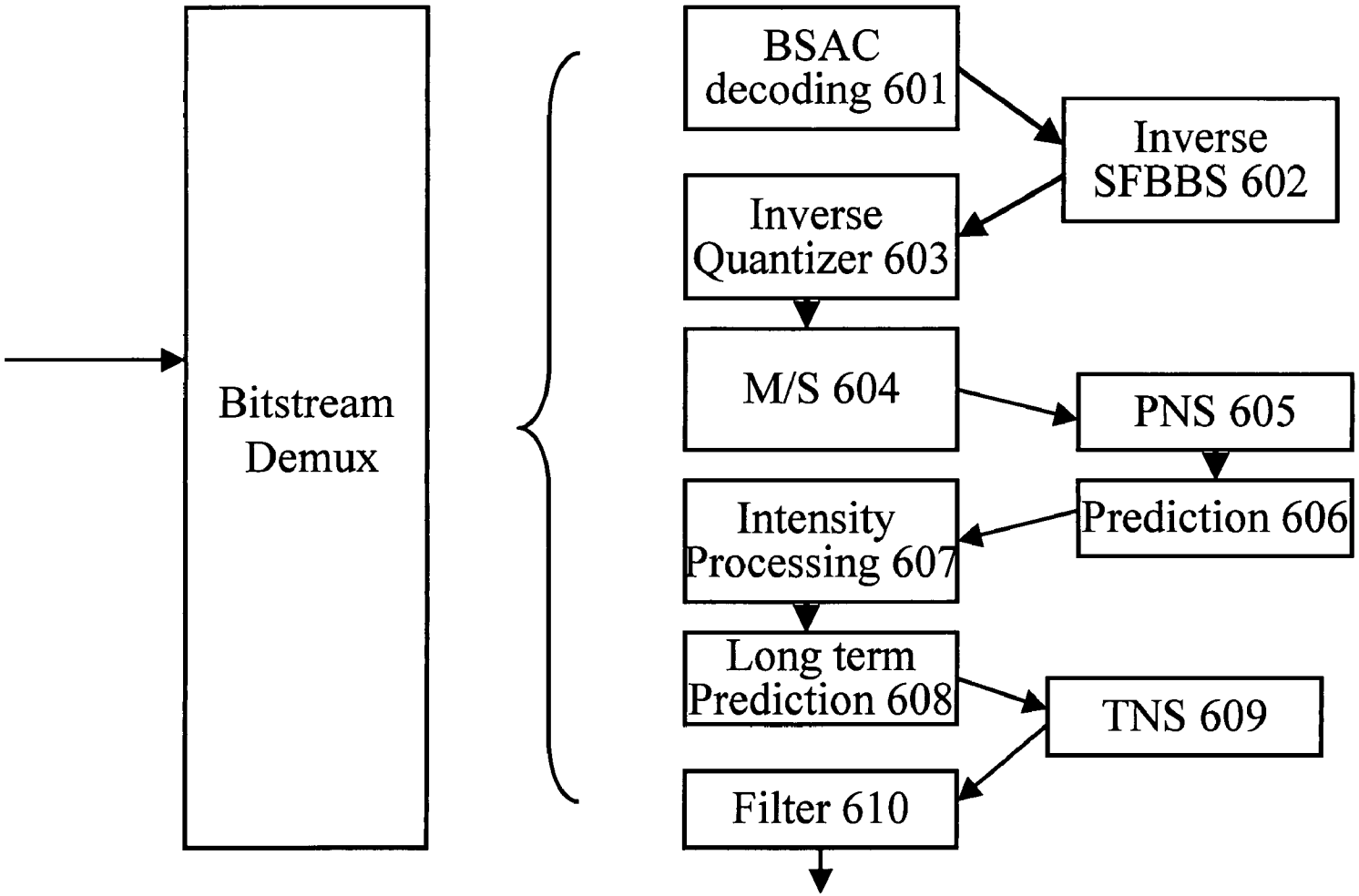

In one aspect, the present invention utilizes Huffman coding, run length (RL) coding or arithmetic coding (AC), e.g., in an MPEG4 system with a bit slice arithmetic coder (BSAC). FIGS. 5 and 6 are block diagrams respectively illustrating an exemplary BSAC encoder and decoder in a structure embedded with scale factor based bit shifting (SFBBS) according to yet another embodiment of the present invention. In one aspect, this embedded structure is advantageously implemented in MPEG-4 BSAC.

Accordingly, the encoder comprises a filter 502, psychoacoustic model 501, temporal noise shaper or TNS 503, prediction modules 504, 506 and 507, intensity processor 505, M/S processor 508, quantizer 509, SFBBS shifter 510 and bit slice arithmetic coder 511. Filter 502 converts input audio signals from a time domain to a frequency domain. Psychoacoustic model 501 couples the frequency domain signals converted by filter 502 by signals of sub-bands corresponding to scale factors. A masking threshold at each sub-band is calculated using a masking phenomenon generated by interaction with the respective signals. TNS 503, optionally used in the encoder, controls the temporal noise shape of the quantization noise within each window for signal conversion, which can be temporally shaped by filtering frequency data. Intensity processor 505, also optionally used in the encoder, encodes only the quantized information for the sub-band of one of two channels with the sub-band of the other channel being transmitted. Prediction modules 504, 506 and 507, optionally used in the encoder, estimate frequency coefficients of the current frames. The difference of the predicted values and the actual frequency components is quantized and coded in effectively reducing the, quantity of generated usable bits. M/S processor 508, optionally used in the encoder, respectively converts a left-channel signal and a right-channel signal into additive and subtractive signals of two signals, to then process the same. Quantizer 509 scalar-quantizes the frequency signals of each of the sub-bands so the magnitude of the quantization noise of each sub-band is smaller than the masking threshold in ensuring imperceptibility to the human ear. At SFBBS shifter 510, the quantized data for the plurality of sub-bands are bit shifted by the respective scale factors if they exceed a threshold value, as set forth herein according to the principles of the present invention. At bit slice arithmetic coder 511, the quantized frequency data are coded by combining the side information (including scale factors) of the corresponding sub-band and the quantization information of audio data. Quantized data are sequentially coded in the order ranging from the most significant bit (MSB) sequences to the least significant bit (LSB) sequences, and from the lower frequency components to the higher frequency components. Left and right channels are alternately coded in vectors to perform coding of a base layer. After the base layer is coded, the side information (including scale factors) for the next enhancement layer and quantized data are coded so the thus-formed bit streams have a layered structure. Bit streams are then generated and multiplexed for transmission to the decoder.

Referring to FIG. 6, the decoder in the embedded structure embodiment according to the present invention comprises a bit slice arithmetic decoder 601, SFBBS de-shifter 602, de-quantizer 603, M/S processor 604, prediction modules 605, 606 and 608, intensity processor 607, TNS 609 and filter 610. As the bit streams for the coded data are received and de-multiplexed, the header information and coded data are separated in the order of generation of the bit streams. Bit slice arithmetic decoder 601 decodes the side information (including scale factors) and bit sliced quantized data in the order of generation of the input bit streams. At SFBBS de-shifter 602, the coded data are de-shifted by the respective scale factors in the sub-bands in accordance with the principles of the present invention as set forth herein. At de-quantizer 603, the decoded data are de-quantized. M/S processor 604 processes the sub-band corresponding to the M/S processing performed in the encoder. If estimation is performed in the encoder, prediction modules 605, 606 and 608 search the same values as the decoded data in the previous frame through estimation in the same manner as in the encoder. The predicted signal is added with a decoded and de-multiplexed difference signal in restoring the original frequency components. TNS 609 controls the temporal shape of quantization noise with each window for conversion from the frequency domain to the time domain. The decoded data are restored as temporal signals using a conventional audio algorithm such as MC in MPEG-4. De-quantizer 603 restores the decoded scale factor and quantized data into signals having the original magnitudes. Filter 610 then converts the de-quantized signals into signals of a temporal domain.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

We claim:

1. A method for processing audio signals comprising:

quantizing the audio signals in spectral lines into quantized data in a plurality of sub-bands in an order of most significant bits to least significant bits;

determining, according to a psychoacoustic model, a plurality of scale factors corresponding to the plurality of sub-bands according to respective noise tolerance of each of the sub-bands;

for each scale factor that exceeds a threshold value, bit shifting the quantized data in the corresponding sub-band by the scale factor, wherein the threshold value is predetermined according to a desired noise tolerance level;

coding the quantized data; and truncating the quantized data.

2. The method of claim 1 further comprising:

de-shifting the coded data;

de-quantizing the coded data; and decoding the coded data.

3. The method of claim 2 further comprising:

amplifying the quantized data with the respective scale factors; and de-amplifying the decoded data with the respective scale factors.

4. The method of claim 2 further comprising determining a difference between the quantized data and the de-quantized data.

5. The method of claim 1 further comprising coding the quantized data in a base layer and an enhancement layer.

6. The method of claim 5 further comprising truncating the quantized data in the enhancement layer to comply with respective layer size limits.

7. The method of claim 1 further comprising one of Huffman coding, run length (RL) coding or arithmetically coding the quantized data.

8. The method of claim 1, wherein the scale factor of a sub-band is determined based upon an original spectral energy level, a common scale factor, and band scale factor values of the sub-band.

9. The method of claim 1 further comprising converting the audio signals from a time domain to a frequency domain.

10. The method of claim 2 further comprising converting the decoded data from a frequency domain to a time domain.

11. A scale factor based bit shifting (SFBBS) system having an encoder and decoder to process audio signals, comprising:

an encoder including a quantizer to quantize the audio signals in spectral lines into quantized data in a plurality of sub-bands in an order of most significant bits to least significant bits;

a psychoacoustic model to determine a plurality of scale factors corresponding to the plurality of sub-bands according to respective noise tolerance of each of the sub-bands;

a coder to code the quantized data;

a de-quantizer to de-quantize the quantized data;

a subtractor to take a difference between the quantized data and the de-quantized data;

a bit shifter to shift the difference by the corresponding scale factor in each of the sub-bands in which the corresponding scale factor exceeds a threshold value, wherein the threshold value is predetermined according to a desired noise tolerance level; and a bit slicer to code and truncate the difference.

12. The system of claim 11 further comprising:

a decoder having a scale factor decoder to decode the scale factors;

a spectrum decoder to decode the quantized data;

a de-shifter to de-shift the coded data; and a decoder to decode the coded data.

13. The system of claim 11, the encoder further comprising a filter to convert the quantized data from a time domain to a frequency domain.

14. The system of claim 12, the decoder further comprising a filter to convert the decoded data from a frequency domain to a time domain.

15. The system of claim 12, the decoder further comprising an adder to add the decoded data.

16. The system of claim 12, wherein the quantized data are amplified with the respective scale factors, and the decoded data are de-amplified with the respective scale factors.

17. The system of claim 11 further comprising one of a run length (RL) encoder, Huffman encoder or bit slice arithmetic encoder to code the quantized data.

18. The system of claim 11 being implemented in an additive fine granularity scalability (FGS) structure.

19. The system of claim 11 wherein the least significant bits are discarded after the bit shifting.

20. The system of claim 11 wherein the quantized difference is coded in a base layer and an enhancement layer, and the quantized difference in the enhancement layer is truncated to comply with respective layer size limits.

21. A method for processing audio signals comprising:

quantizing the audio signals in spectral lines into quantized data in a plurality of sub-bands in an order of most significant bits to least significant bits;

determining, according to a psychoacoustic model, a plurality of scale factors corresponding to the plurality of sub-bands according to respective noise tolerance of each of the sub-bands;

for each scale factor that exceeds a threshold value, bit shifting the quantized data in the corresponding sub-band by the scale factor, wherein the threshold value is predetermined according to a desired noise tolerance level;

coding the quantized data in a base layer; and truncating the quantized data.

22. The method of claim 21 further comprising:

de-shifting the coded data;

de-quantizing the coded data; and decoding the coded data.

23. The method of claim 21 further comprising discarding the least significant bits after the bit shifting.

24. The method of claim 21 further comprising:

coding the quantized data in a base layer and an enhancement layer; and truncating the quantized data in the enhancement layer to comply with respective layer size limits.

25. The method of claim 21 further comprising one of Huffman coding, arithmetically coding or run length (RL) coding the quantized data.

26. The method of claim 21, wherein the scale factor of a sub-band is determined based upon an original spectral energy level, a common scale factor, and band scale factor values of the sub-band.

27. The method of claim 21, the method being implemented in an additive fine granularity scalability (FGS) structure.

28. A scale factor based bit shifting (SFRBS) system having an encoder and decoder to code and decode, respectively, audio signals, wherein the encoder comprises:

a quantizer to quantize the audio signals in spectral lines into quantized data in a plurality of sub-bands in an order of most significant bits to least significant bits;

a psychoacoustic model to determine a plurality of scale factors corresponding to each of the sub-bands according to respective noise tolerance of each of the sub-bands;

a bit shifter to shift the quantized data by the corresponding scale factor in each of the sub-bands in which the corresponding scale factor exceeds a threshold value, wherein the threshold value is predetermined according to a desired noise tolerance level; and a bit slicer to code and truncate the quantized data.

29. The system of claim 28, wherein the decoder comprises:

a scale factor decoder to decode the scale factors;

a spectrum decoder to decode the quantized data;

a de-shifter to de-shift the coded data; and a decoder to decode the coded data.

30. The system of claim 28 being implemented in MPEG-4 bit slice arithmetic coding (BSAC).

31. A method for processing audio signals, comprising:

quantizing the audio signals in spectral lines into quantized data in a plurality of sub-bands in an order of most significant bits to least significant bits;

determining, according to a psychoacoustic model, a plurality of scale factors corresponding to each of the sub-bands according to respective noise tolerance of each of the sub-bands;

de-quantizing the quantized data;

for each scale factor that exceeds a threshold value, bit shifting the quantized data in the corresponding sub band by the scale factor, wherein the threshold value is predetermined according to a desired noise tolerance level; and coding and truncating the quantized difference.

32. The method of claim 31 further comprising:

de-shifting the coded data; and decoding the coded data.

33. The method of claim 32 further comprising:

amplifying the quantized data with the respective scale factors; and de-amplifying the decoded data with the respective scale factors.

34. The method of claim 31 further comprising one of Huffman coding, run length (RL) coding or arithmetically coding the quantized data.

35. The method of claim 31 wherein the least significant bits, after the bit shifting, are discarded.

36. A scale factor based bit shifting (SFBBS) processor for processing audio signals in an order of most significant bits to least significant bits, the processor comprising:

a psychoacoustic module to determine a plurality of scale factors corresponding to a plurality of spectral sub-bands according to respective noise tolerance of each of the sub-bands;

a bit shifter to shift the processed audio signals by the corresponding scale factor in each of the spectral sub-bands in which the corresponding scale factor exceeds a threshold value, wherein the threshold value is predetermined according to a desired noise tolerance level; and a bit slicer to code and truncate the processed audio signals.

37. The processor of claim 36 further comprising a quantizer to quantize the processed audio signals.

38. The processor of claim 36 further comprising:

a quantizer to quantize the processed audio signals;

a de-quantizer to de-quantize the processed audio signals; and a subtractor to take a difference between the quantized audio signals and the de-quantized audio signals.

* * * * *